United States Patent [19]

Merry

[11] 4,390,163

[45] Jun. 28, 1983

[54] MARINE BLOCK

[75] Inventor: Carl A. Merry, Marion, Mass.

[73] Assignee: Schaefer Marine, Inc., New Bedford, Mass.

[21] Appl. No.: 387,952

[22] Filed: Jun. 14, 1982

Related U.S. Application Data

[63] Continuation of Ser. No. 297,227, Aug. 28, 1981, abandoned.

[51] Int. Cl.[3] ..... B66D 1/36

[52] U.S. Cl. ..... 254/412; 308/190

[58] Field of Search ..... 254/412, 416, 404, 901, 254/401-403, 405-406, 409-411; 114/101, 102, 218, 220; 242/157 R; 308/190, 208

[56] References Cited

U.S. PATENT DOCUMENTS

| | | | |
|---|---|---|---|
| 817,074 | 4/1906 | LaRose | 254/412 X |
| 1,185,179 | 5/1916 | Chattaway | 254/411 |
| 1,185,535 | 5/1916 | Purdy | 254/411 |
| 1,574,799 | 3/1926 | Dierks | 254/404 X |
| 1,713,587 | 5/1929 | Wright | 254/409 |
| 2,408,899 | 10/1946 | Wright | 308/208 |
| 3,528,645 | 9/1970 | Harken | 254/412 |

*Primary Examiner*—John M. Jillions

*Attorney, Agent, or Firm*—Cesari and McKenna

[57] ABSTRACT

A marine block employs a sheave which is rotatively mounted on an axle supported between a pair of spaced-apart cheek plates. One or more ball bearing units are provided between the axle and the sheave, each unit containing a circular array of ball bearings which engage in circular races which are disposed radially outward from the axis of the axle. Relatively large ports are formed in the cheek plates which are located directly opposite the bearing units whereby a water stream directed through the ports at one side of the block can penetrate around and between the exposed ball bearings and their races and scrub those surfaces free of dirt and film. In a preferred block embodiment, clearance spaces exist radially inboard of the sheave between the bearing units and between the sheave and the cheek plates so that water can travel directly through the block and between the sheave and the cheek plates to further facilitate cleaning the block.

7 Claims, 5 Drawing Figures

MARINE BLOCK

RELATED APPLICATION

This application is a continuation of application Ser. No. 06/297,227, filed Aug. 28, 1981 entitled IMPROVED MARINE BLOCK, now abandoned.

BACKGROUND OF THE INVENTION

This invention relates to pulleys generally. It relates more particularly to an improved marine block.

Marine blocks or pulleys are used to facilitate drawing lines to move sails, booms and other parts, particularly on a sailboat. Such a block invariably includes a pair of spaced-apart cheek plates for supporting the opposite ends of an axle. A sheave is rotatively mounted on the axle between the plates. The plates are shackled to a fixed support and the line is trained around the sheave. If the block is to operate properly, it is essential that the sheave rotate freely on its axle. This is especially so in the case of marine blocks which are used to facilitate raising and lowering sails and the like, which efforts must be accomplished readily in a minimum amount of time, especially when racing. Accordingly, usually a ball bearing unit is incorporated between the sheave and axle to enable the sheave to rotate freely.

After a time, however, pulleys generally and marine blocks in particular do not operate as well as they might because the sheave does not always rotate freely on its axle. This is because dirt, salt and other debris tends to accumulate between the sheave and the block cheek plates and more importantly at the rotary joint between the sheave and the block axle. Even if that joint includes a bearing unit, the bearings and their races become fouled so as to inhibit free rotation of the sheave.

In the case of some blocks, it is possible to alleviate this problem by disassembling the block and cleaning its various parts. However, in order to clean the block in that fashion, it must be disconnected and taken out of service before that maintenance step can be performed. That, of course, requires considerable time and effort on the part of the boat owner. Many blocks, however, cannot be disassembled; their cheek plates are permanently riveted together. Therefore, in the case of those blocks, that option is not even available to the boat owner.

SUMMARY OF THE INVENTION

Accordingly, it is an object of the present invention to provide an improved marine block which can be cleaned easily while remaining in service.

Another object of the invention is to provide a marine block whose rotary joint between the sheave and the block axle can be flushed free of dirt and other debris as necessary to assure free running of the block sheave.

Yet another object of the invention is to provide a block of this type which is quite strong and capable of handling high tensile loads.

A further object of the invention is to provide a marine block which has a minimum number of different parts which are easily assembled.

A further object of the invention is to provide a block of this type whose sheave has an especially low-friction rotary joint.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

In general, the present sheave employs a pair of spaced-apart cheek plates which support the opposite ends of an axle. A sheave is positioned between the plates and rotates about the axle. The cheek plates extend appreciably beyond the periphery of the sheave opposite at least one sector thereof in order to support the opposite ends of a pin which functions as a spacer between the cheek plates and as a point of connection to a shackle or other piece of marine hardware for anchoring the block. Also, a circular array of relatively large ports or openings are formed in each cheek plate appreciably radially outboard of the axle.

The sheave of the present block is not rotatively mounted directly to the axle as is the case with most conventional marine blocks. Rather, the axle supports a relatively large diameter discoid spacer bushing between the cheek plates. The periphery of the bushing is profiled to form at least one circular bearing race situated just inboard of the adjacent cheek plate or plates.

The sheave of the present block has a central opening whose radius is somewhat larger than the radius of the bushing. Furthermore the opposite ends of that central opening are counterbored to form at least one circular bearing race. When the sheave is positioned between the cheek plates coaxially with the block axle, each race on the sheave is positioned directly opposite a bushing race disposed radially inboard of the sheave thereby forming one or more generally toroidal tracks in which rolls a relatively loose circular array of ball bearings.

The positions of the races formed in the sheave and bushings are such that the bearings in each bearing array are always exposed in the ports formed in the cheek plates defining the opposite sides of the block. Resultantly, when a stream of water is directed through the cheek plate ports at one side of the block, the water travels directly into the toroidal bearing track defined by the race at that side of the block. The water stream also impinges directly upon the ball bearings in that track. The ball bearings are free to rotate about their centers under the influence of the water stream so that substantially their entire surfaces are scrubbed free of film and dirt which might inhibit their revolving freely when the block is in use.

Also, because the diameter of the sheave opening is somewhat larger than the diameter of the bushing about which the sheave rotates, an appreciable gap exists between those two elements. Resultantly, the water is free to flow between the loosely arrayed ball bearings and through that annular gap to the toroidal bearing track, if present, at the opposite side of the block. There also, the water stream flows around and between the bearings engaged in that track and out through the ports in the cheek plate at the opposite side of the block. Resultantly, the races and bearings at both sides of the block are cleaned thoroughly.

Still further, the water stream entering through the cheek plate ports is also free to travel between the opposite sides of the sheave and the inside walls of the cheek plates so that dirt and film are also flushed from those spaces. Thus, the present block can be cleaned easily as needed to ensure that the block sheave runs freely. Moreover, since the flushing water stream can be aimed directly into the bearing races from each side of the block and even right through the block, the block can be cleaned thoroughly while remaining in service.

Finally, especially if it has a double bearing array construction, the present block is extremely strong and long lived. Yet as will be seen presently, it is composed of a relatively small number of different parts. Therefore, it is relatively economical to make.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
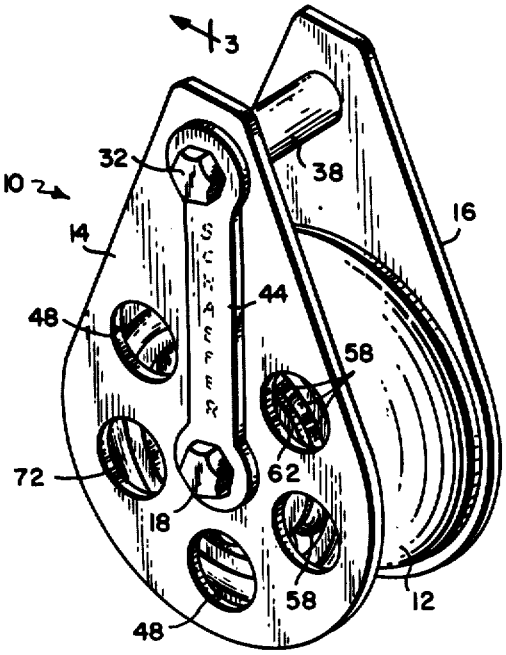
FIG. 1 is an isometric view of a marine block embodying the principles of my invention.

Referring to FIG. 1 of the drawings, the present marine block indicated generally at 10 includes a sheave 12 which is rotatively mounted between a pair of identical, spaced-apart cheek plates 14 and 16. While the illustrated plates have a generally teardrop shape, other shapes may be used depending upon the function of the particular block.

The two plates are held together at their lower ends by a bolt 18 or other comparable connector such as a rivet which extends through an opening 22 in plate 14 and an aligned opening 24 in plate 16. A cylindrical spacer bushing 26 is engaged on the bolt between the plates and a nut 28 is turned down onto the threaded end of the bolt. In addition to serving as a spacer, the bolt and bushing function as the axle for sheave 12. The upper ends of the cheek plates are held in spaced relation by a similar arrangement. More particularly, a connector bolt 32 extends through an opening 34 adjacent the upper end of plate 14 and through an aligned opening 36 in plate 16. A cylindrical spacer bushing 38 sheaths the bolt between the plates and a nut 42 is turned down onto the threaded end of the bolt 32. In addition to serving as a spacer, the bolt 32 and bushing 38 function as the attaching point of the block to a shackle or other fitting for anchoring the block.

Figure 3:
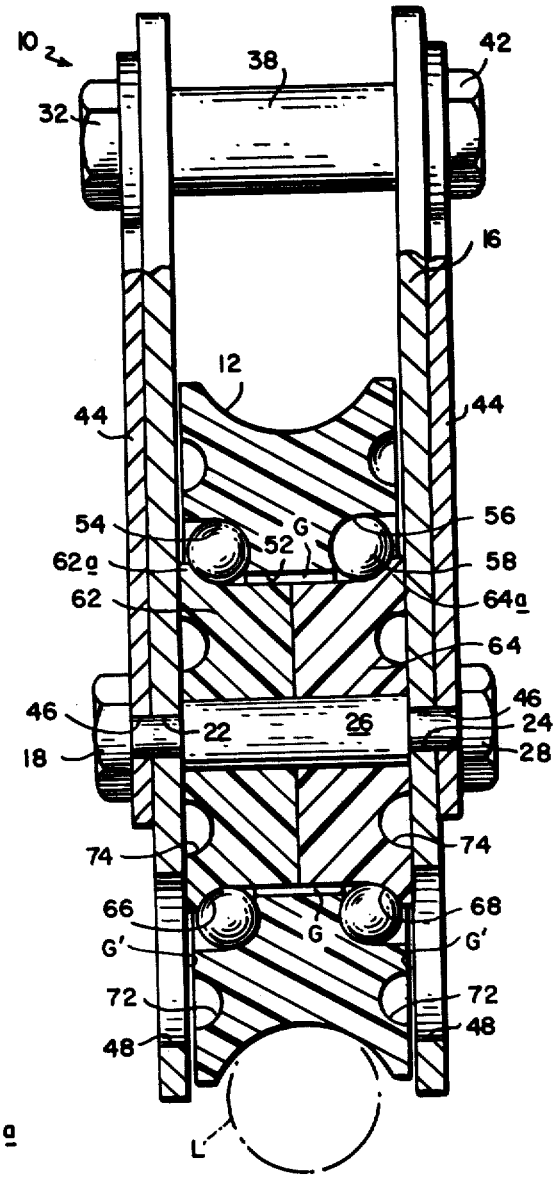
FIG. 3 is a sectional view on a larger scale along line 3—3 of FIG. 1.
Figures 4, 5:
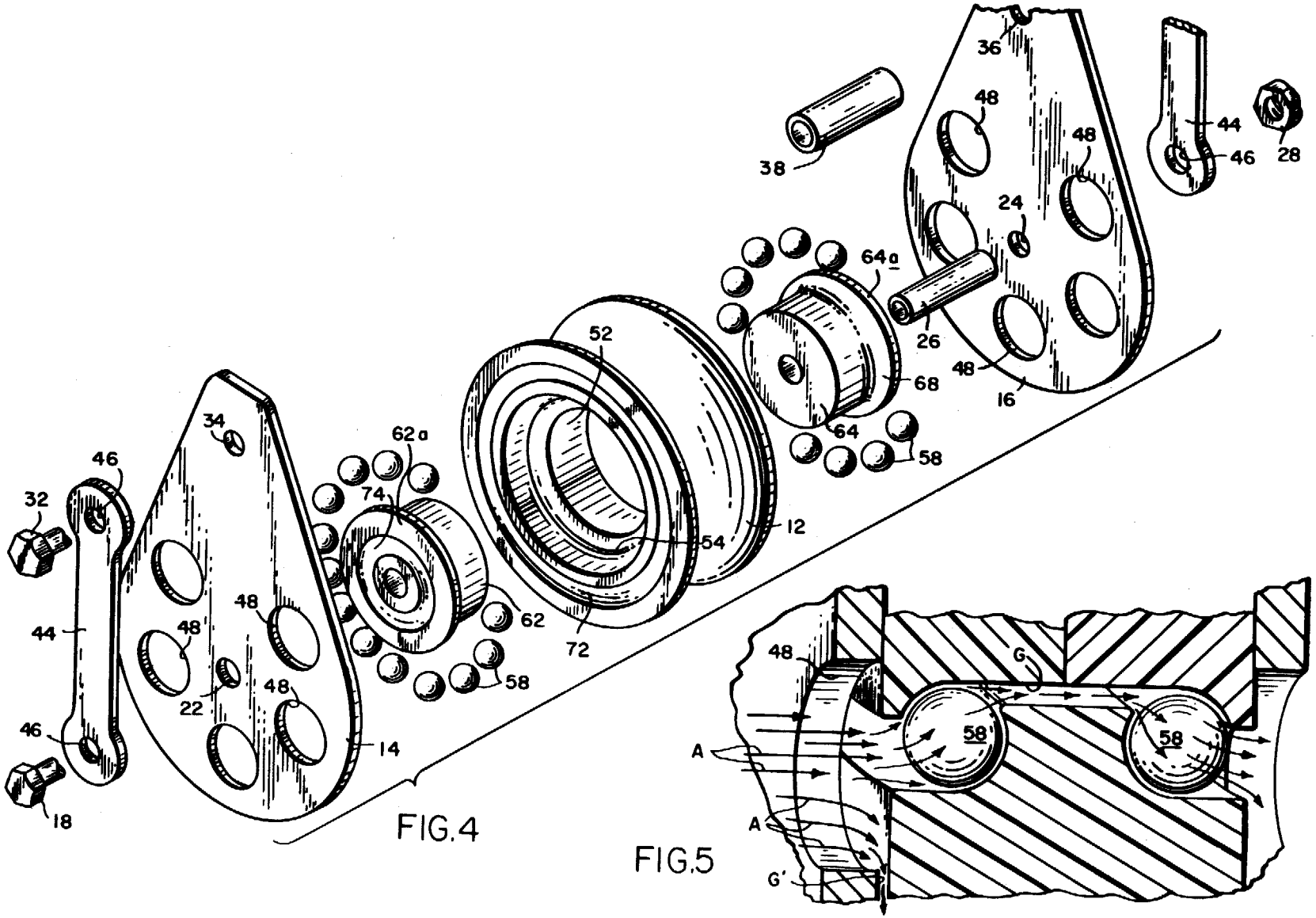
FIG. 4 is an exploded perspective view showing the components of the FIG. 1 block in greater detail.
FIG. 5 is a fragmentary sectional view on a much larger scale illustrating the operation of the block.

Preferably a pair of elongated metal straps 44 are secured to the opposite sides of the block by means of bolts 18 and 32. For this purpose, the straps are provided with bolt-receiving end openings 46 as best seen in FIGS. 3 and 4. These straps rigidify the cheek plates. They also increase the tensile strength of the block between the bolt 32 where the block is anchored by way of a bracket B and the bolt 18 where the load is applied by a line L engaged around sheave 12, the bracket and line being shown in dotted lines in FIG. 3. In addition, the straps 44, usually being of a contrasting color to the cheek plates, perform a decorative function.

As shown in FIGS. 1, 3 and 4, the cheek plates 14 and 16 are each provided with a circular array of openings or ports 48. These ports have a relatively large diameter and are situated an appreciable distance radially outboard of the bolt 18.

As best seen in FIGS. 3 and 4, the sheave 12 is provided with a relatively large diameter central opening 52. Also the opposite ends of opening 52 are counterbored to form a pair of circular bearing races 54 and 56. Each race has a generally circular profile for seating a circular array of ball bearings 58.

Sheave 12 actually rotates about a pair of mirror image discoid bushings 62 and 64 which are sandwiched face to face between the cheek plates 14 and 16 and form spacer means along with spacer bushing 26. Actually, because of the strong plastic materials available today, the bushing 26 can be omitted if desired since the discoid bushings 62 and 64 also function together as a spacer between the cheek plates 14.

The bushing flanges **62*a* and 64*a* which are located adjacent the cheek plates are shaped to form a pair of circular bearing races 66 and 68. These races also have a circular sectional profile which matches the curvature of the ball bearings 58. Thus the sheave and bushing races at each side of the block define a pair of toroidal tracks in which the ball bearings 58** are free to rotate and around which they are free to travel.

Figure 2:
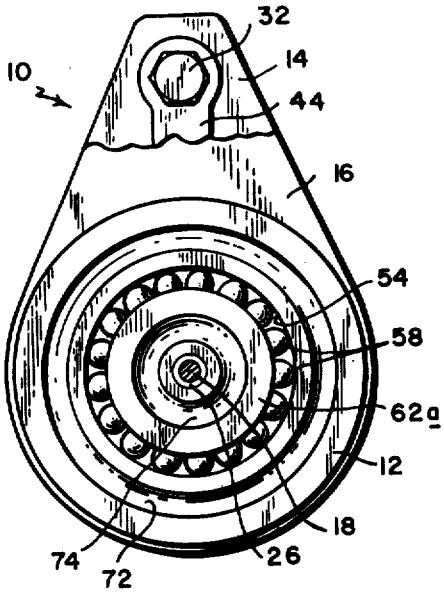
FIG. 2 is an elevational view thereof with one cheek plate broken away.

As best seen in FIG. 2, the bearings are relatively loosely arrayed in their respective tracks so that a certain amount of clearance may exist between adjacent ball bearings in each array. Also as noted previously, the diameter of the sheave opening 52 is somewhat larger than the diameter of the bushings 62 and 64 so that an appreciable annular gap G exists between the sheave and the bushings as shown in FIGS. 3 and 5. Also as shown in those same figures, there is a relatively wide clearance space or gap G' between each side of sheave 12 and the inside wall of the adjacent cheek plate 14, 16.

A circular groove 72 is formed in each side of sheave 12 radially outboard of the bearing races 54 and 56 to save material and to reduce weight. However, these grooves also facilitate cleaning the sheave as will be described later. A similar groove 74 is provided in the outboard side of each bushing 62 and 64 to save material.

Referring now to FIGS. 1, 3 and 5, it is readily apparent that the toroidal bearing tracks at opposite sides of the block are exposed through the ports 48 in the two cheek plates 14 and 16, as are the ball bearings 58 which run in those tracks. Furthermore, as noted previously, the ball bearings are relatively loosely arrayed in their respective tracks so that gaps can exist between the adjacent balls in each array. Resultantly, when a swift stream of water indicated by the arrows A in FIG. 5 is played against one side of the block 10, the water stream enters the ports 48 on that side of the block and impinges upon the ball bearings exposed in those ports. Resultantly, the ball bearings 58 are agitated and rotated in their track so that they are scrubbed clean of dirt and film. Additionally, the water stream passes between the bearings and travels along the bearing races 54 and 66 as shown by the arrows A in FIG. 5 so that those races are also cleansed. Some rotation of the sheave 12 also occurs due to the water stream or can be made to occur by rotating sheave 12 so that different bearings and sheave race segments are exposed in the ports. Still further, some of the water is free to pass through the annular gap G to the opposite side of the block as shown by the arrows A in FIG. 5 where it proceeds to agitate and cleanse the bearings 58 at that location. Additionally, water travels around the races 56 and 68 at that side of the block so that those surfaces are cleaned as well.

Also, due to the clearance between the sides of the sheave 12 and the inside walls of the cheek plates 14 and 16, a portion of the water stream A travels through the annular gaps G' between the sheave 12 and the cheek plates 14 and 16 scrubbing those surfaces free of dirt and film. Resultantly, a brief flushing of the block 10 results in the block being thoroughly cleaned so that its sheave rotates freely on its axle. Moreover, this maintenance step can be performed without disassembling the block and even while the block is still in place. Of course, for best results, water should be directed against both sides of the block to ensure that a high velocity water stream impinges directly upon both bearing arrays.

Referring now to FIG. 4, the subject block is composed of a relatively few different parts. The cheek plates 14 and 16 are identical, being made of a suitable metal such as stainless steel or anodized aluminum. The bolts 18 and 32, the bushings 26 and 38, the straps 44, the bearings 58, which are made of steel, also form identical parts groups. The identical bushings 62 and 64 and the sheave are formed of a suitable strong impact resistant material such as ABS or Delrin plastic. Actually, in some cases, the spacer bushing 26 can be eliminated because the plastic bushings 62 and 64 also function together as a spacer for the cheek plates.

To assemble the block 10, one simply inserts the bolts 18 and 32 through the strap openings 46 of strap 44 and through the cheek plate openings 22 and 34 in plate 14. Then, the spacer bushings 26 and 38 are engaged over bolts 18 and 32, respectively. Following this, bushing 62 is received onto spacer bushing 26 assuming one is used, the sheave 12 is positioned opposite the bushing 62 and the bearings 58 are arrayed between the races 54 and 66. Then, the other bushing 64 is positioned on spacer bushing 26 with the bearings 58 arrayed between the races 56 and 68. Next, the cheek plate 16 is located on the ends of the bolts 18 and 32 followed by the other strap 44. Finally, the nuts 28 and 42 are turned down onto the bolts 18 and 32 respectively to complete the assembly of the block.

While we have specifically illustrated a block that can be disassembled because nuts and bolts are used to retain its parts, the subject block can be constructed equally as well using rivets in lieu of bolts so that the cheek plates 14 and 16 cannot be taken apart after assembly. In that event, because of the in-line construction of the cheek plate ports 48 and the bearings and bearing races and the annular sheave gap G, the block can still be cleansed thoroughly.

Finally, if the block 10 employs two completely separate arrays of ball bearings 58 on opposite sides of the block, the sheave 12 can be loaded to an appreciable extent without any danger of the sheave cocking relative to its axle or its surfaces becoming excessively worn. Therefore, the block 10 should have a relatively long useful service life and require minimum maintenance.

While we have specifically illustrated a block with arrays of bearings at opposite sides of the block, the same principles can be incorporated into a single bearing array block capable of handling even greater loads. In this event, the sheave bushing is composed of three mirror image sections which define a single large peripheral race intermediate its ends. Likewise, the sheave has only one large race disposed opposite the bushing race. A plurality of large balls ride in these bearing races. Again, all the balls rolling in the races and the races themselves are exposed in the cheek plate ports 48 at opposite sides of the block, bringing all the advantages described above.

It will thus be seen that the objects set forth above, among those made apparent from the preceding description, are efficiently attained. Also, certain changes may be made in the above construction without departing from the scope of the invention. For example, the same basic arrangement can be used to mount both sheaves of a double sheave block, such as a fiddle block, to facilitate cleaning that marine hardware item. Therefore, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. A marine block comprising

A. a pair of similar cheek plates,

B. first and second spacer means for maintaining the cheek plates in parallel, spaced-apart relation, C. a sheave, D. bearing means for rotatively mounting the sheave on said first spacer means (1) said bearing means including at least one spaced-apart circular race, and (2) a circular array of bearing elements engaged in each race, and E. means defining relatively large ports in said cheek plates directly opposite the bearing means so that water streams can be directed through said ports from opposite sides of the block so as to scrub the surfaces of the bearing elements and the race free of film and dirt.

2. The block defined in claim 1

A. wherein said block includes two races, each containing a bearing element array, disposed on opposite sides of the block just inboard of the cheek plates, and B. further including means defining an annular gap between said first spacer means and said sheave between said races whereby water directed through the ports in the cheek plate at one side of the blocks can flow around and between the bearing elements exposed in those ports and through said gap to the bearing elements and race on the opposite side of the block and thence through the ports in the cheek plate at said side of the block.

3. The block defined in claim 1 and further including shackle-supporting means loosely mounted to said second spacer means.

4. The block defined in claim 1 and further including annular clearance spaces between opposite sides of the sheave and the inboard surfaces of the cheek plates so that water directed through the cheek plate ports can flow through said spaces and flush them free of dirt and film.

5. A marine block comprising

A. a pair of similar cheek plates,

B. first and second connector means for maintaining the cheek plates in parallel relation, C. a pair of mirror-image bushings mounted on said first connector means between said cheek plates, said bushings defining at least one bearing race located just inboard of a cheek plate, D. an annular sheave engaged around said bushings, said sheave being formed with at least one circular bearing race extending around its inner diameter directly opposite the bushing race, E. a circular array of ball bearings in rolling engagement with each bushing race and sheave race, and F. a plurality of relatively large ports formed in each of said cheek plates, each said port exposing the inboard sheave and bushing races and the bearings therein whereby water streams can be directed through the ports at opposite sides of the block for scrubbing the surfaces of the bearings and races free of dirt and film.

6. The block defined in claim 5 wherein the inside diameter of the sheave is dimensioned to provide an appreciable clearance gap around the bushings so that a flushing water path through the block is defined by the cheek plate ports, the spaces between the ball bearings and said clearance gap so that the interior block parts can be cleansed by directing a water stream against a side of the block.

7. The block defined in claim 6 wherein the sheave is further dimensioned to provide annular clearance spaces between the sides of the sheave and the cheek plates so that a portion of the water directed through the ports at the sides of the block flows through said annular clearance spaces, thereby washing the surfaces defining those spaces free of film and dirt.

* * * * *